US010729971B1

(12) United States Patent
Lengyel

(10) Patent No.: US 10,729,971 B1
(45) Date of Patent: Aug. 4, 2020

(54) SCRATCH BOARD WITH RECEPTACLE

(71) Applicant: Jennifer Lynn Lengyel, Bridgeville, PA (US)

(72) Inventor: Jennifer Lynn Lengyel, Bridgeville, PA (US)

( * ) Notice: Subject to any disclaimer, the term of this patent is extended or adjusted under 35 U.S.C. 154(b) by 0 days.

(21) Appl. No.: 16/401,005

(22) Filed: May 1, 2019

(51) Int. Cl.
*A63F 3/06* (2006.01)
*B42F 9/00* (2006.01)

(52) U.S. Cl.
CPC ..... *A63F 3/068* (2013.01); *B42F 9/002* (2013.01); *A63F 3/06* (2013.01); *A63F 3/065* (2013.01); *A63F 3/0625* (2013.01); *A63F 3/0695* (2013.01); *B42P 2241/16* (2013.01)

(58) Field of Classification Search
CPC ..... A63F 3/068; A63F 3/0625; A63F 3/065; A63F 3/0695; A63F 3/06; B42F 9/002; B42P 2241/16
USPC ..... 273/139, 269, 287, 148 R, 148 A, 309
See application file for complete search history.

(56) References Cited

U.S. PATENT DOCUMENTS 4,106,773 A * 8/1978 Coefield ..... A63F 3/0423 273/240
9,849,371 B1 * 12/2017 Grahl ..... A63F 3/068
2009/0134579 A1 * 5/2009 Milbourne ..... A63F 3/0625 273/309
2011/0127180 A1 * 6/2011 Vogias ..... A63F 3/0625 206/232
2013/0247358 A1 * 9/2013 Watson ..... A63F 3/068 29/559
2015/0151193 A1 * 6/2015 Sartini ..... A63F 3/068 273/309
2019/0247742 A1 * 8/2019 Edwards ..... A63F 3/0625

* cited by examiner

*Primary Examiner* — Benjamin Layno
(74) *Attorney, Agent, or Firm* — Maier & Maier, PLLC

(57) ABSTRACT

A scratch board for lottery tickets and the like. The board includes a body having a planar portion, the planar portion having a flat front surface, and a curved portion extending from the lower end of the planar portion and forwardly of the planar portion, a clip coupled to the planar portion and adapted to securely maintain a flat object against the planar portion, a dowel removably affixed to the planar portion, and a receptacle sized to receive one or several coins. The board can also include a cylinder rotatably disposed within the curved portion, the cylinder including an outer wall, an internal cavity, and a slot defined through the outer wall.

17 Claims, 2 Drawing Sheets

SCRATCH BOARD WITH RECEPTACLE

CROSS-REFERENCE TO RELATED APPLICATIONS

This application claims priority to U.S. Provisional Patent Application No. 62/762,373, filed May 2, 2018, and entitled "The Lucky Board," the contents of which are hereby incorporated herein in their entirety.

BACKGROUND

Lotteries are a popular form of gambling where participants choose random numbers to win a jackpot that is typically several magnitudes larger than the cost of entry. One popular form of lottery involves tickets where a person chooses several numbers out of a larger set of numbers (for example, six out of sixty) that are then matched to an official drawing that may be held at regular periods. Another popular form of lottery does not involve a drawing, but involves small cards with prize information that is concealed by a covering. A person can scratch off the covering to reveal the information underneath. These are known as instant lottery cards, scratch cards, or scratch-and-win lotteries.

To scratch off the opaque covering, one places the scratch card on a hard surface and typically uses an edge of a hard object such as a coin, which provides sufficient friction to remove the covering. Due to the friction, the scratch card must be held in place. Therefore, a user typically has to find a hard, flat surface and then use both hands to execute the scratch-off action. This can pose an inconvenience in situations where such surfaces are not readily available. Additionally, the scrapings of the opaque covering tend to both obscure the scratch card or scatter into the surroundings, requiring the user to clean it up. Accordingly, a solution is desired to these and other inconveniences.

SUMMARY

According to at least one exemplary embodiment, a scratch board for lottery tickets and the like is disclosed. The board includes a body having a planar portion, the planar portion having a flat front surface, and a curved portion extending from the lower end of the planar portion and forwardly of the planar portion, a clip coupled to the planar portion and adapted to securely maintain a flat object against the planar portion, a dowel removably affixed to the planar portion, and a receptacle sized to receive one or several coins. The board can also include a cylinder rotatably disposed within the curved portion, the cylinder including an outer wall, an internal cavity, and a slot defined through the outer wall.

According to another exemplary embodiment, the scratch board includes a body having a planar portion, the planar portion having a flat front surface, and a curved portion extending from the lower end of the planar portion and forwardly of the planar portion, and a cylinder disposed within the curved portion, the cylinder including an outer wall and an internal cavity, the longitudinal axis of the cylinder being parallel to the longitudinal axis of the curved portion. A slot is defined through the outer wall of the cylinder, and a slit is defined through the curved portion. The cylinder is rotatable such that when the cylinder is in a first position, the internal cavity is in communication with an external environment via the slot, when the cylinder is in a second position, the internal cavity is not in communication with the external environment, and, when the cylinder is in a third position, the internal cavity is in communication with the external environment via the slot and the slit.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
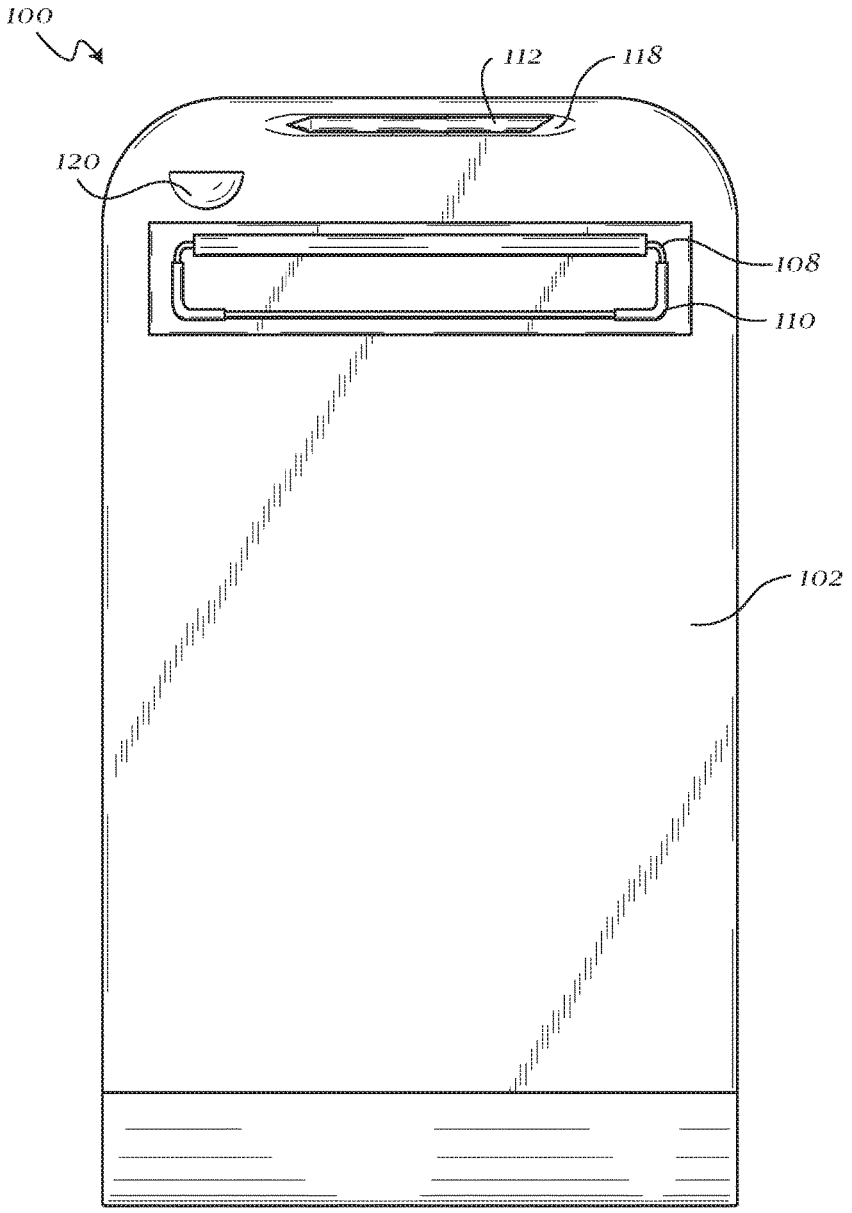
FIG. 1 shows a front view of an exemplary embodiment of a scratch board.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation. The terms "upper", "lower", "front", "rear", "forward", and "rearward" should be interpreted in conjunction with the orientation of the embodiments shown in the drawings.

Figure 2:
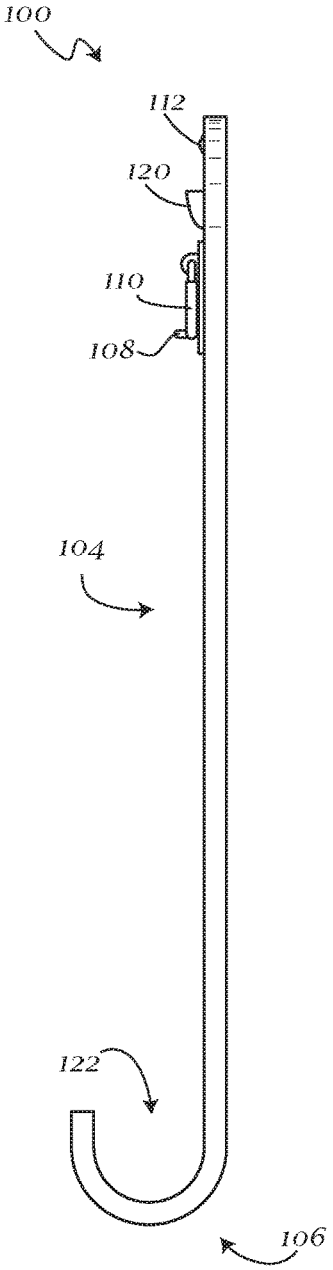
FIG. 2 shows a side view of an exemplary embodiment of a scratch board.

According to at least one exemplary embodiment, and as shown in FIGS. 1-2, a scratch board 100 is disclosed. The scratch board 100 has a body 102 with a generally planar portion 104 and a curved portion 106 disposed at the lower end of the body. The body 102 may be formed from a unitary piece of material such that planar portion 104 smoothly transitions into curved portion 106, presenting a visually unbroken surface. The upper corners of planar portion 104 may be curved.

Disposed at the upper end of the planar portion 104 is a clip 108 for maintaining a lottery ticket or other planar object securely engaged against body 102. Clip 108 may be a spring-actuated clip as known in the art, and may include resilient members 110 which cushion the snap-back action of the clip and provide additional friction in engaging the planar objects. In other embodiments, any known device to retain the planar objects as described herein may be utilized.

Figure 3:
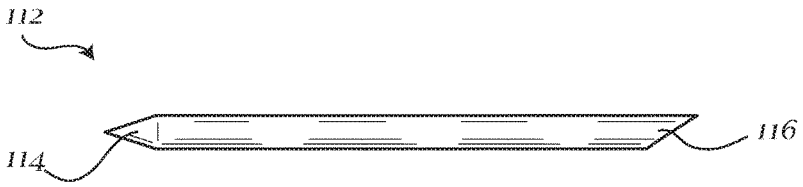
FIG. 3 shows a side view of an exemplary embodiment of a dowel.

Also disposed at the upper end of planar portion 104 and removably affixed to body 102 is a dowel 112. Shown also in FIG. 3, dowel 112 can have a cylindrical shape and include a pointed end 114 and an angled end 116. Angled end 116 may have an angle of 45° to the longitudinal axis of dowel 112. Angled end of dowel 112 can aid the user in scratching off the opaque covering of lottery tickets, while the pointed end 114 can provide more precise control over the areas to be scratched off.

Dowel 112 may be disposed within a slot or recess 118 defined in the surface of body 102. The dowel can be firmly retained within the recess, yet easily detachable from body 102, for example by friction fit, magnetism, hook-and-loop fasteners, or any other removable attachment means known in the art. In other embodiments, dowel 112 may be detachably coupled to body 102 in any desired manner.

A coin slot 120 can also be disposed at the upper end of planar portion 104. The coin slot is sized and shaped to receive one or several common-sized coins therein. Coin slot 120 may have a substantially semi-hemispherical shape, or any other shape that enables the coin slot to function as described herein.

The curved portion 106 disposed at the lower end of body 102 arcuately extends forward of planar portion 104 and has a cross-section that can be a semicircle or a longer arc. The diameter of curved portion 106 may be less than the height of planar portion 104, for example, less than 50% of the height of planar portion 104, or, more specifically, 10%-20% of the height of planar portion 104. Curved portion 106 creates a reservoir 122, within which the scrapings of the opaque covering may be received and maintained. In some embodiments, a pair of side walls may be provided at the transverse ends of reservoir 122, flush with the side edges of body 102 and extending from the bottom of curved portion 106 to between half of the height and the full height of curved portion 106. The side walls can aid in retaining the scrapings within reservoir 106.

Figure 4:
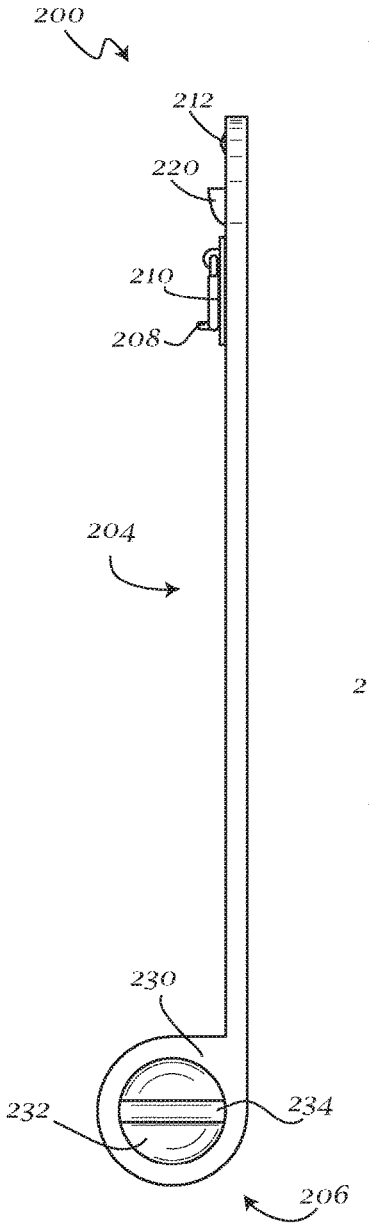
FIG. 4 shows a side view of a second exemplary embodiment of a scratch board.
Figure 5:
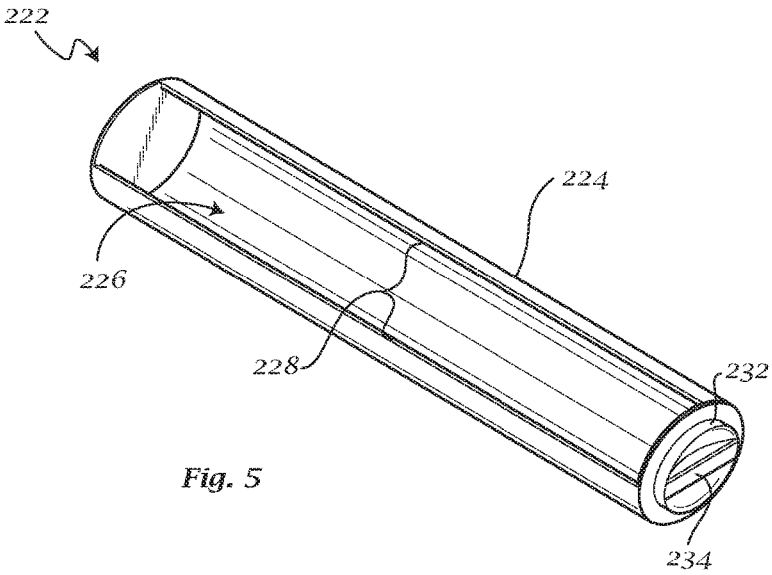
FIG. 5 shows an isometric view of a rotatable reservoir for the second exemplary embodiment of a scratch board.
Figure 6:
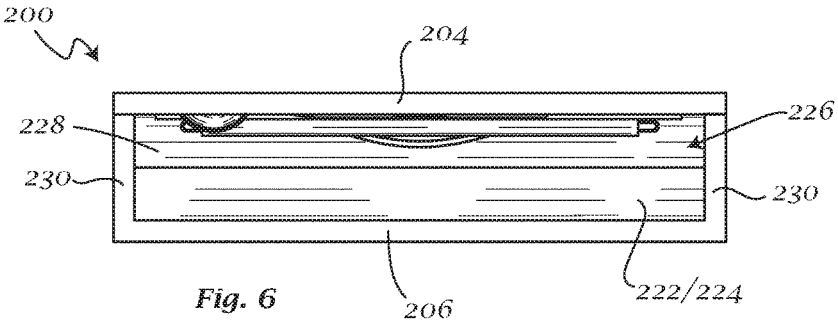
FIG. 6. shows a top view of a second exemplary embodiment of a scratch board.
Figure 7:
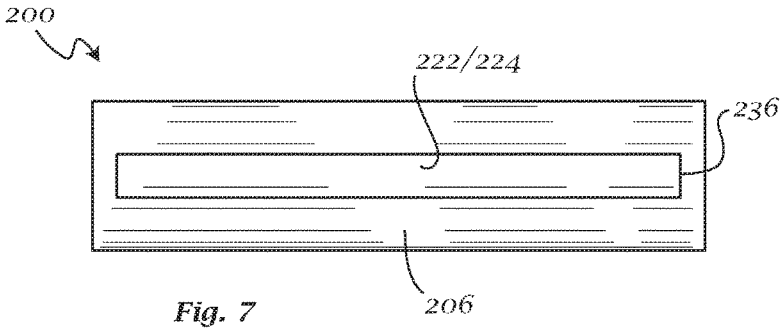
FIG. 7 shows a bottom view of a second exemplary embodiment of a scratch board.

Turning to FIGS. 4-6, another embodiment of scratch board 200 is disclosed. Similar features herein are denoted by similar figures but with a leading digit of 2. In the embodiment of scratch board 200, the reservoir 222 may be provided as a rotatable cylinder 224. Cylinder 224 includes an internal cavity 226 which is in communication with the exterior via slot 228. Slot 228 may extend approximately the length of cavity 226 in the longitudinal direction and may have an arc of approximately a quarter of the circumference of cylinder 224.

Cylinder 224 is sized such that it rotatably fits within the inner curve of curved portion 206, i.e., the outer circumference of cylinder 224 is slightly less than the circumference of the inner surface of curved portion 206. The ends of cylinder 224 have nubs 232 having a radius less than that of cylinder 224, with the nubs being sized to fit snugly and rotatably into apertures defined in side walls 230. Grips 234 defined at the ends of nubs 232 allow the user to rotate cylinder 224 within curved portion 206.

The bottom end of curved portion 206 has a slit 236 defined therethrough. Rotating cylinder 224 allows the user to align slot 228 with the open end of curved portion 206, allowing the scrapings to fall into cavity 226. Slot 228 can also be aligned with the inner surface of curved portion 206, securely maintaining the scrapings within cavity 226, for example when transporting scratch board 200. Finally, cylinder 224 can be rotated to align slot 228 with slit 236, allowing the scrapings to fall out of cavity 226 to be disposed.

Embodiments of the scratch board can include additional features. For example, a stand coupled to the back surface of the scratch board so as to allow the scratch board to be placed in an upright or angled position; magnets, nail slots, hook-and-loop fasteners, or other types of fasteners so as to allow the scratch board to be attached to various surfaces; and other implementations of enclosed reservoirs may all be contemplated and provided as desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A scratch board, comprising:

a body having a planar portion, the planar portion having a flat front surface, and a curved portion extending from the lower end of the planar portion and forwardly of the planar portion;

a clip coupled to the planar portion and adapted to securely maintain a flat object against the planar portion;

a dowel removably affixed to the planar portion;

a receptacle sized to receive one or several coins; and a cylinder rotatably disposed within the curved portion, the cylinder including an outer wall, an internal cavity, and a slot defined through the outer wall.

2. The board of claim 1, wherein the planar portion is integrally formed with the curved portion.

3. The board of claim 1, further comprising a pair of side walls disposed at the transverse ends of the curved portion.

4. The board of claim 1, the dowel further comprising a pointed end and a tapered end.

5. The board of claim 1, wherein the dowel is disposed within a recess defined in the surface of the planar portion.

6. The board of claim 1, further comprising a pair of grips disposed at the transverse ends of the cylinder.

7. The board of claim 1, further comprising a slit defined through the bottom of the curved portion.

8. The board of claim 1, further comprising:

a pair of side walls disposed at the transverse ends of the curved portion;

an aperture defined in each side wall;

a nub extending from each transverse end of the cylinder, the nub sized to fit within the aperture.

9. A scratch board, comprising:

a body having a planar portion, the planar portion having a flat front surface, and a curved portion extending from the lower end of the planar portion and forwardly of the planar portion;

a cylinder disposed within the curved portion, the cylinder including an outer wall and an internal cavity, the longitudinal axis of the cylinder being parallel to the longitudinal axis of the curved portion;

a slot defined through the outer wall of the cylinder; and a slit defined through the curved portion;

wherein the cylinder is rotatable such that:

when the cylinder is in a first position, the internal cavity is in communication with an external environment via the slot;

when the cylinder is in a second position, the internal cavity is not in communication with the external environment; and when the cylinder is in a third position, the internal cavity is in communication with the external environment via the slot and the slit.

10. The board of claim 9, further comprising a clip coupled to the planar portion and adapted to securely maintain a flat object against the planar portion.

11. The board of claim 9, further comprising a dowel removably affixed to the planar portion.

12. The board of claim 11, the dowel further comprising a pointed end and a tapered end.

13. The board of claim 11, wherein the dowel is disposed within a recess defined in the surface of the planar portion.

14. The board of claim 9, further comprising a receptacle sized to receive one or several coins.

15. The board of claim 9, further comprising a pair of grips disposed at the transverse ends of the cylinder.

16. The board of claim 9, further comprising:

a pair of side walls disposed at the transverse ends of the curved portion;

an aperture defined in each side wall;

a nub extending from each transverse end of the cylinder, the nub sized to fit within the aperture.

17. The board of claim 9, wherein the slot has an arc that is approximately 25% of the circumference of the cylinder.

* * * * *